United States Patent [19]

Stroud et al.

[11] 4,084,925

[45] Apr. 18, 1978

[54] OIL WELL PUMP WITH SELF-CONTAINED LUBRICATION

[76] Inventors: Ruben Jasper Stroud, 11988 N. Ventura Ave., Ojai, Calif. 93023; Robert Clayton Simonson, 1132 Poli Ave., Ventura, Calif. 93001

[21] Appl. No.: 713,115

[22] Filed: Aug. 10, 1976

[51] Int. Cl.[2] ..... F04B 21/04; F01B 31/00

[52] U.S. Cl. ..... 417/554; 92/86.5

[58] Field of Search ..... 92/86.5, 251, 83; 417/430, 431, 432, 545–554

[56] References Cited

U.S. PATENT DOCUMENTS

| | | | |
|---|---|---|---|
| 1,083,957 | 1/1914 | Trist | 92/159 |
| 1,160,840 | 11/1915 | Calvert | 92/251 |
| 1,457,546 | 6/1923 | Namura | 92/159 |
| 1,660,210 | 9/1926 | Ashton | 92/251 |
| 1,690,393 | 11/1928 | Beloit | 417/554 |
| 1,949,612 | 3/1934 | Mattair et al. | 92/159 |
| 2,349,253 | 5/1944 | Edmund | 92/159 |
| 2,371,846 | 3/1945 | Ruthven | 417/430 |
| 3,104,619 | 9/1963 | Swarthout | 92/86.5 |
| 3,267,872 | 8/1966 | Bloudoff | 417/430 |
| 3,592,567 | 7/1971 | Tolbert | 417/432 |

*Primary Examiner*—William L. Freeh
*Attorney, Agent, or Firm*—Ralph B. Pastoriza

[57] ABSTRACT

The oil well pump includes upper and lower seals at the upper and lower end portions of a plunger reciprocable within the pump barrel. Passages are provided in the wall of the plunger for introducing a lubricating fluid in the annular space between the outer wall of the plunger and the inner wall of the barrel between the upper and lower seals. These passages are subsequently sealingly closed to trap the lubricating fluid in the annular volume and thereby provide lubrication for the pump.

2 Claims, 3 Drawing Figures

OIL WELL PUMP WITH SELF-CONTAINED LUBRICATION

This invention relates to oil well pumps and more particularly to an improved construction for a combined bailer and fluid pump assuring grit free lubrication for movement of the plunger and in the pump barrel during operation.

BACKGROUND OF THE INVENTION

Oil well pumps are well known in the industry and generally are located at the lower portion of well tubing which serves as a passage for pump fluid. Essentially, such pumps include a barrel through which a plunger is reciprocated by an appropriate rod extending upwardly through the well tubing to an appropriate driver at ground level. The plunger is provided with a one-way check valve which passes fluid to be pumped into the plunger on its down stroke and closes on the up stroke so that the fluid is lifted through the tubing to the surface.

A special problem with such pumps resides in proper lubrication for movement of the plunger within the pump barrel. Various types of seals have been provided between the plunger and inside wall of the barrel in an effort to keep out sand or grit from between the outside wall of the plunger and inside wall of the barrel itself which sand or grit can damage the pump and result in the necessity of frequent replacement.

An example of a solution to the proposed problem is set forth in U.S. Pat. No. 3,773,441 issued Nov. 20, 1973 and entitled *COMBINED SAND BAILER AND FLUID PUMP WITH AUTOMATIC GRIT SEPARATOR AND LUBRICATOR.* The pump and bailer described in this patent provides a fluid reservoir communicating through a filter with oil being pumped. This reservoir is in the form of an annular chamber about the plunger between the inside walls of the barrel and exterior walls of the plunger between appropriate upper and lower seals. Essentially, part of the oil being pumped is bypassed through the filter into the reservoir wherein the same serves as a lubricant for movement of the plunger and is maintained free of grit, sand and the like by the filter arrangement.

The basic concept of providing an annular fluid reservoir filled with oil or fluid as a lubricating medium has solved the problem of frequent pump replacement. On the other hand, the manufacturing cost and maintenance of the pump itself is somewhat increased, replacement of the filter being required periodically. There still appears to be room for improvement in a combined pump and bailer which can function for long periods without abrasion by grit and sand working to the area between the plunger and barrel walls wherein relative reciprocating movement takes place.

BRIEF DESCRIPTION OF THE PRESENT INVENTION

With the foregoing considerations in mind, the present invention contemplates just such as improved oil well pump and bailer in which the various advantages set forth in the heretofore mentioned prior patent can be realized but without the necessity of providing filters and the like.

More particularly, in accord with the present invention, the pump plunger within the barrel is provided with upper and lower seals extending radially from the outer wall of the plunger to engage the inside wall surface of the barrel and define therebetween an annular sealed reservoir. However, rather than attempting to replenish a lubricating fluid in this reservoir with oil being pumped which necessitates filters and the like, in accord with the present invention there are provided first and second passages in the wall of the plunger communicating between exterior ports and the annular sealed reservoir. Prior to connection of the pump to a tubing string, a lubricating fluid is introduced into one of these passages to completely fill the annular reservoir, air escaping out the other of the passages. The exterior ports are then sealingly closed by appropriate plugs to permanently seal the fluid in the reservoir.

The sealed fluid, is, of course, free of any grit and the like and will function as a lubricant for reciprocating movement of the plunger in the barrel thereby greatly extending the life of the plunger.

BRIEF DESCRIPTION OF THE DRAWINGS

A better understanding of the improved pump and bailer of this invention will be had by referring to the accompanying drawings in which.

DETAILED DESCRIPTION OF THE PREFERRED EMBODIMENT

Figure 1:
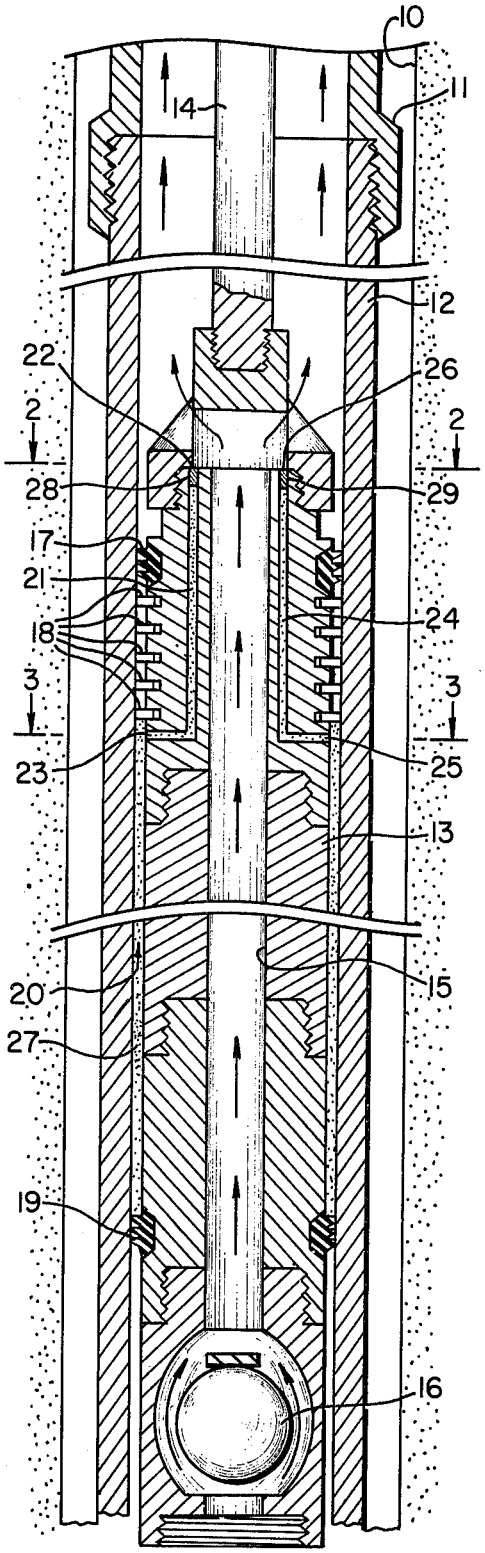
FIG. 1 is a cross section of a bore hole showing the pump in the end of a tubing string and wherein certain parts are shown in full lines.

Referring first to the upper portion of FIG. 1, there is shown a bore hole 10 having a tubing string the lower portion of which is shown at 11.

The combined bailer and pump connects to the lower end of the tubing string 11 and includes a tubular barrel 12 incorporating a plunger 13, the upper end of the plunger being connected to a rod 14 passing up through the tubing string 11 to the surface of the bore hole in order to reciprocate the plunger 13 longitudinally along the barrel 12.

The plunger 13 includes a central bore 15 incorporating a ball type check valve 16. When the plunger 13 and check valve 16 move up and down in the barrel 12, it will be evident that on the down stroke, fluid can pass by the check valve as indicated by the arrows whereas when the plunger is moved upwardly, the check valve will seat, thereby blocking reverse flow so that the fluid or oil is lifted up through the tubing string 11 to the surface of the bore hole.

The plunger 13 is also provided with an upper seal means in the form of annular rubber collars 17 below which are provided steel ring sections 18 extending radially outwardly to engage the inside wall surface of the barrel 12.

Similarly, there is provided a lower seal means in the form of annular rubber collars 19 radially extending to engage the inner wall of the barrel 12. There is thus defined between the upper and lower seal means and the outer wall of the plunger 13 and inner wall of the barrel 12 an annular sealed reservoir designated generally by the numeral 20.

As shown adjacent to the upper seal means 17 and 18, there is provided a first passage 21 in the wall of the plunger 13 extending between a first exterior port 22 outside the seal means to an inlet port 23 communicating with said annular sealed reservoir 20. On the diametrically opposite side of the plunger wall 13 a second passage 24 extends between an outlet port 25 communicating with the annular sealed reservoir 20 and a second exterior port 26 outside of the seal means.

A lubricating fluid 27 completely fills the annular sealed reservoir 20, this lubricating fluid being introduced through the first passage 21, air escaping during the filling from the second passage 24. The filling operation takes place before the pump is used.

After the sealed annular reservoir 20 has been completely filled, the exterior ports 22 and 26 are respectively sealingly closed by appropriate plugs 28 and 29 to thereby permanently seal the lubricating fluid within the annular sealed reservoir 20.

Figure 2:
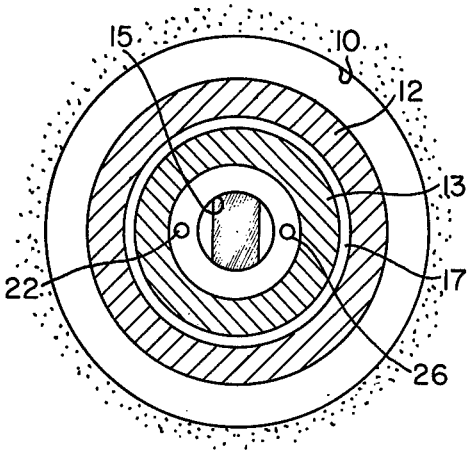
FIG. 2 is a cross section taken in the direction of the arrows 2—2 of FIG. 1; and, FIG. 3 is another cross section taken in the direction of the arrows 3—3 of FIG. 1.
Figure 3:
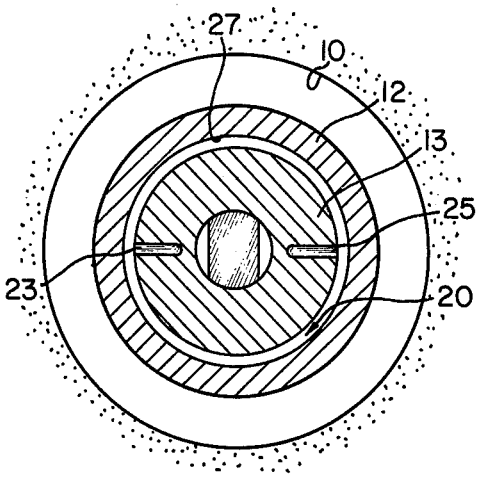

In the cross section of FIG. 2, the exterior outlet ports 22 and 26 are clearly visible while in the cross section of FIG. 3, the inlet port passage 23 and outlet port passage 25 communicating with the sealed annular reservoir 20 are shown.

OPERATION

The combined bailer and pump operates in the usual manner, the annular sealed reservoir 20 being filled with a clean lubricating fluid prior to use of the pump as described. With the fluid permanently sealed by means of the plugs 28 and 29, it remains trapped between the exterior portion of the plunger 13 and inner wall of the barrel 12 between the upper and lower seals and serves to lubricate the reciprocating motion of the plunger in the barrel.

As already described, the downstroke of the plunger by the rod 14 will cause oil to pass by the ball check valve 16 into the tubing string and be lifted to the surface upon the upstroke of the plunger.

The permanently sealed lubricating fluid 27 provides proper lubrication for the reciprocating movement of the plunger for long periods and thus frequent replacement of the pumps is avoided.

Moreover, the foregoing unique feature of providing a sealed reservoir of clean lubricating fluid avoids the necessity of auxiliary passages, filters, and the like as characterize some of the prior art lubricating systems.

From the foregoing, it will thus be evident that the present invention has provided an improved bailer and pump incorporating a self-lubricating feature built into the pump in a permanent manner.

What is claimed is:

1. An oil well pump for connection in the lower end of a tubing string including a rod for actuating said pump, comprising, in combination:

a. a tubular barrel;

b. a plunger in said barrel connected to said rod for reciprocating movement and having an inner bore;

c. a check valve incorporated in said inner bore of said plunger;

d. upper and lower spaced seal means on the exterior of said plunger radially extending from the outer wall of said plunger to engage the inside wall surface of said barrel and define therebetween an annular sealed reservoir;

e. a first passage in the wall of said plunger extending between a first exterior port outside said seal means to an inlet port communicating with said annular sealed reservoir;

f. a second passage in the wall of said plunger extending between an outlet port communicating with said annular sealed reservoir and a second exterior port outside said seal means;

g. a lubricating fluid completely filling said annular sealed reservoir; and h. plug means sealingly closing said first and second ports after said lubricating fluid has been introduced into said reservoir through said first passage and air therein driven out through said second passage, whereby reciprocating movement of said plunger in said barrel is lubricated by said fluid in said reservoir.

2. A pump according to claim 1, in which said upper sealing means includes a plurality of annular rubber collars surrounding the upper portion of said plunger and a plurality of annular steel ring sections below said rubber collars, said lower sealing means including a plurality of rubber collars.

* * * * *